US008295738B2

(12) United States Patent
Kikuchi

(10) Patent No.: US 8,295,738 B2
(45) Date of Patent: Oct. 23, 2012

(54) DEVELOPING UNIT CONTAINING A REDUCTION PORTION AND IMAGE FORMING APPARATUS USING THE DEVELOPING UNIT

(75) Inventor: Mutsumi Kikuchi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 371 days.

(21) Appl. No.: 12/625,236

(22) Filed: Nov. 24, 2009

(65) Prior Publication Data

US 2010/0247152 A1 Sep. 30, 2010

(30) Foreign Application Priority Data

Mar. 25, 2009 (JP) ..... 2009-073259

(51) Int. Cl.
*G03G 15/09* (2006.01)

(52) U.S. Cl. ..... 399/254; 399/279; 399/281; 399/283; 399/284; 399/286

(58) Field of Classification Search ..... 399/254, 399/279, 281, 283, 284, 286
See application file for complete search history.

(56) References Cited

U.S. PATENT DOCUMENTS

2009/0185831 A1* 7/2009 Kotera et al. ..... 399/254

FOREIGN PATENT DOCUMENTS

| | | | |
|---|---|---|---|
| JP | 05-046016 | A | 2/1993 |
| JP | 2001-34066 | A | 2/2001 |
| JP | 2003-57954 | A | 2/2003 |
| JP | 2007-232841 | A | 9/2007 |

OTHER PUBLICATIONS

English Translation of JP 2001-34066 to Sakami, Feb. 2001.*
Notification of Reasons for Refusal dated Jan. 25, 2011, in Japanese Application No. 2009-073259.

* cited by examiner

*Primary Examiner* — Ryan Walsh
(74) *Attorney, Agent, or Firm* — Sughrue Mion, PLLC

(57) ABSTRACT

A developing unit including a retainer receiving portion for receiving a developer retainer, a first agitation portion adjacent to the retainer receiving portion, a second agitation portion adjacent to the first agitation portion, a first conveyance member received in the first agitation portion, a second conveyance member received in the second agitation portion, a layer thickness limiting member made of a magnetic material and disposed between the second conveyance member and the developer retainer to limit the layer thickness of a developer retained on the surface of a retaining member, and a blocking portion disposed on the upstream side of the layer thickness limiting member in the rotation direction of the retaining member and in a space located between the layer thickness limiting member and the second agitation portion to block a developer on the upstream side of the layer thickness limiting member from entering the space.

5 Claims, 8 Drawing Sheets

DEVELOPING UNIT CONTAINING A REDUCTION PORTION AND IMAGE FORMING APPARATUS USING THE DEVELOPING UNIT

CROSS-REFERENCE TO RELATED APPLICATIONS

This application is based on and claims priority under 35 USC 119 from Japanese Patent Application No. 2009-073259 filed on Mar. 25, 2009.

BACKGROUND

Technical Field

The present invention relates to a developing unit and an image forming apparatus.

SUMMARY

[1] According to an aspect of the invention, a developing unit includes a developer retainer, a developing vessel, a first conveyance member, a second conveyance member, a layer thickness limiting member and a reduction portion. The developer retainer includes a magnet member and a retaining member. The magnet member has magnetic poles. The retaining member is supported on an outer circumference of the magnet member and retains a developer magnetized and sucked on a surface of the retaining member by a magnetic force of the magnet member. The developing vessel receives the developer internally and includes a retainer receiving portion, a first agitation portion and a second agitation portion. The retainer receiving portion receives the developer retainer. The first agitation portion is adjacent to the retainer receiving portion. The second agitation portion is adjacent to the first agitation portion. The first conveyance member is received in the first agitation portion and conveys the developer in the first agitation portion in a first conveyance direction. The second conveyance member is received in the second agitation portion and conveys the developer in the second agitation portion in a second conveyance direction which is reverse to the first conveyance direction. The layer thickness limiting member is provided in opposition to the developer retainer to limit a layer thickness of the developer retained on the surface of the retaining member, which is disposed between the second conveyance member and the developer retainer and which is made of a magnetic material. The reduction portion is disposed on an entrance side of the layer thickness limiting member and in a space between the layer thickness limiting member and the second agitation portion. The reduction portion reduces entrance of the developer on an upstream side of the layer thickness limiting member into the space.

BRIEF DESCRIPTION OF THE DRAWINGS

Exemplary embodiments of the invention will be described in detail based on the following figures, wherein.

DETAILED DESCRIPTION

Figure 1:
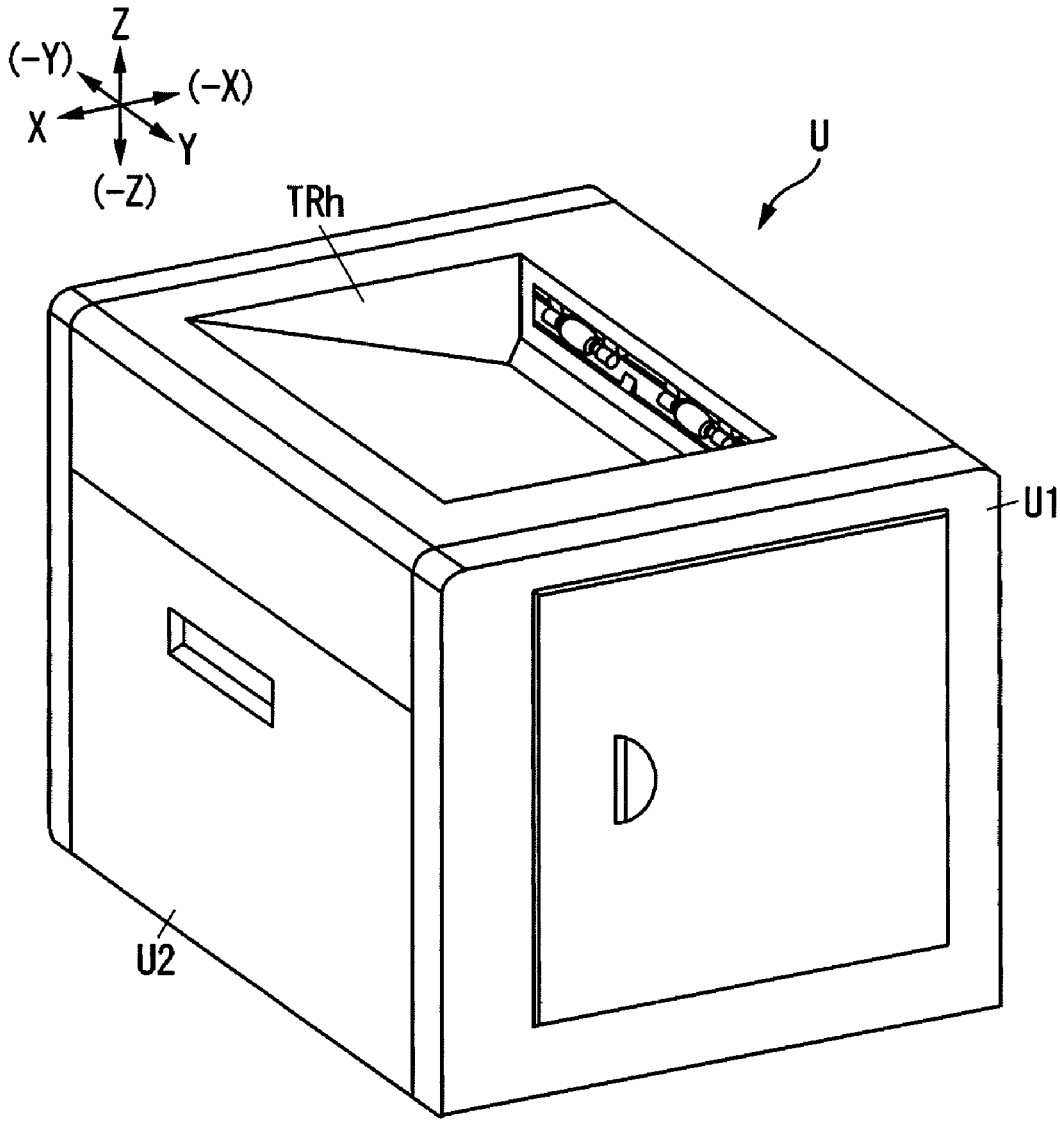
FIG. 1 is an overall perspective view of a printer according to a first embodiment of the invention.

Although specific examples of modes for carrying out the invention (hereinafter referred to as "embodiments") will be described below with reference to the drawings, the invention is not limited to the following embodiments.

In order to facilitate understanding of the following description, in the drawings, the front/rear direction is indicated as an X-axis direction, the left/right direction is indicated as a Y-axis direction and the up/down direction is indicated as a Z-axis direction, and directions or sides designated by the arrows X, -X, Y, -Y, Z and -Z are indicated as the front direction, the rear direction, the right direction, the left direction, the upper direction and the lower direction, or the front side, the rear side, the right side, the left side, the upper side and the lower side respectively.

In the drawings, each arrow with "." written in "○" means an arrow directed from the back side of the sheet to the front side thereof and each arrow with "x" written in "○" means an arrow directed from the front side of the sheet to the back side thereof.

In the following description using the drawings, any other member than members required for description is omitted from the drawings suitably for the purpose of facilitating understanding.

FIG. 1 is an overall perspective view of a printer according to a first embodiment of the invention.

In FIG. 1, a printer U as an image forming apparatus according to the first embodiment of the invention has an image forming apparatus body U1. A front cover U2 is supported in the front surface of the image forming apparatus body U1 so as to be openable around the lower end of the front cover U2. The front cover U2 is an example of an openable member, which is opened/closed for supplying new media. A discharge tray TRh which is an example of a paper discharge portion is provided on the top of the image forming apparatus body U1.

Figure 2:
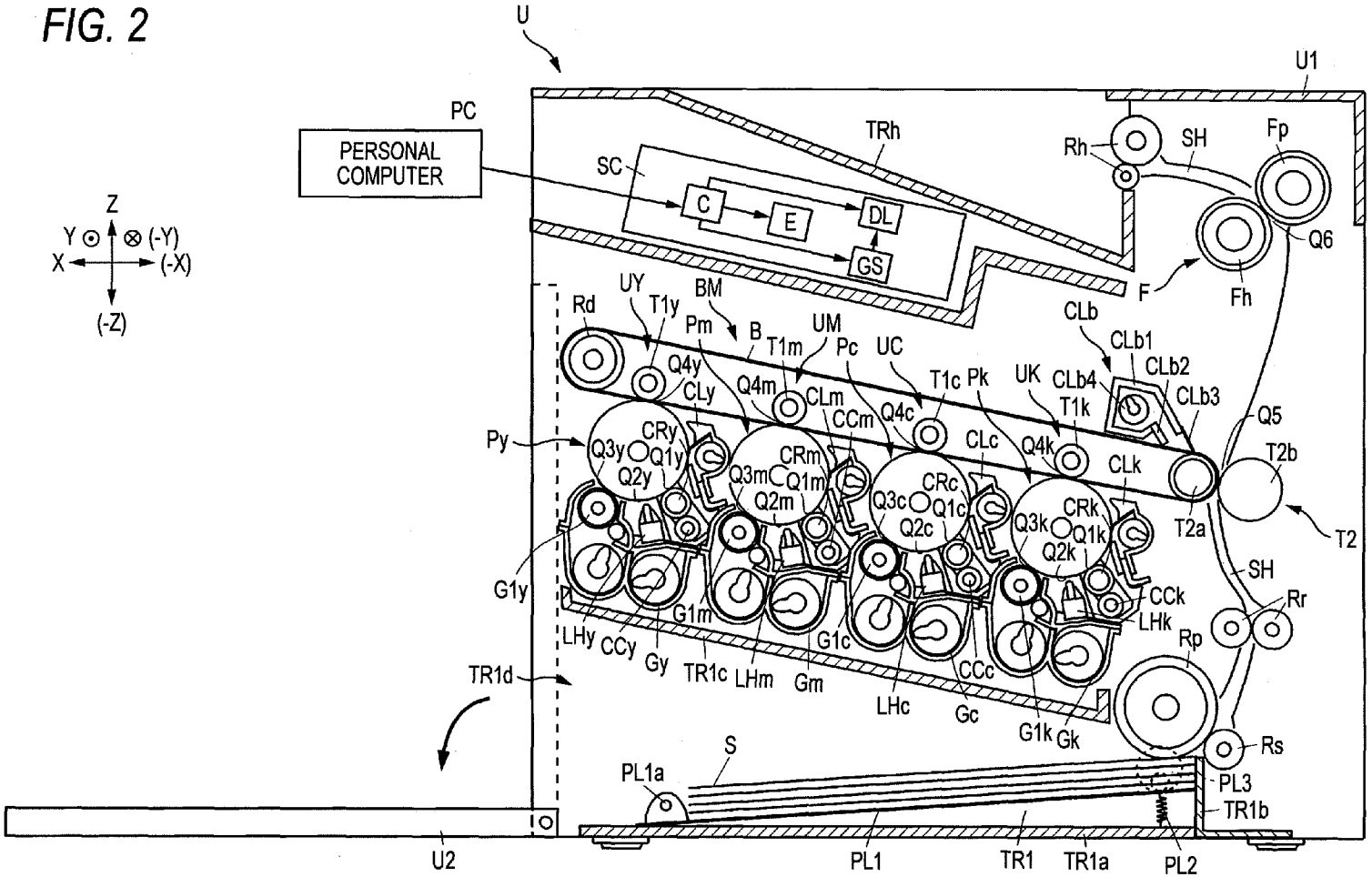
FIG. 2 is an overall explanatory view of an image forming apparatus according to the first embodiment of the invention.

FIG. 2 is an overall view for explaining the image forming apparatus according to the first embodiment of the invention.

In FIGS. 1 and 2, the front cover U2 is supported so as to be movable between an open position shown by the solid line in FIG. 2 and a closed position shown in FIGS. 1 and 2. When the front cover U2 is in the open position, paper as an example of a medium can be inserted.

In FIG. 2, a control board SC where various control circuits, storage media, etc. are arranged is disposed under the discharge tray TRh in the upper portion of the printer U. The control board SC is provided with a control portion C, an image processing portion GS, a latent image forming unit drive circuit DL, a power supply circuit E, etc. The control portion C performs various controls on the printer U. The operations of the image processing portion C, the latent image forming unit drive circuit DL and the power supply circuit E are controlled by the control portion C. The power supply circuit E is an example of a power supply unit. The power supply circuit E applies voltages to each charging roll CRy to CRk as an example of a charger, each developing roll G1*y* to G1*k* as an example of a developer retainer, each transfer roll T1*y* to T1*k* as an example of a transfer, etc., which will be described later.

The image processing portion GS converts print information into image information for forming latent images corresponding to images of four colors of yellow, magenta, cyan and black, that is, Y, M, C and K. The print information is inputted from a personal computer PC or the like as an example of an external information transmitting apparatus. The image processing portion GS outputs the converted image information to the latent image forming unit drive circuit DL.

When an original image is a unicolor image or a so-called monochrome image, image information of only black is inputted to the latent image forming unit drive circuit DL.

The latent image forming unit drive circuit DL has not-shown drive circuits of yellow Y, magenta M, cyan C and black K to output signals corresponding to the input image information to LED heads LHy, LHm, LHc and LHk at given times respectively. Each LED head LHy, LHm, LHc, LHk is an example of a latent image forming unit disposed for each color.

In FIG. 2, visible image forming units UY, UM, UC and UK for forming toner images as examples of visible images of the respective colors, yellow, magenta, cyan and black, are disposed in the lower central portion of the image forming apparatus body U1. In FIG. 2, the visible image forming unit UK of black, that is, the color K has a photoconductor Pk which is an example of a rotary image retainer. The charging roll CRk which is an example of a charger for charging the surface of the photoconductor Pk, the LED head LHk which is an example of a latent image forming unit for forming an electrostatic latent image on the photoconductor surface, a developing unit Gk for developing the electrostatic latent image on the photoconductor surface into a visible image, a photoconductor cleaner CLk which is an example of an image retainer cleaner for removing a developer staying on the surface of the photoconductor Pk, etc. are disposed around the photoconductor Pk.

According to the first embodiment, the magenta and cyan visible image forming units UM and UC are configured in the same manner as the black visible image forming unit UK, but the developing unit Gy of the yellow visible image forming unit UY has a different shape while the other members of the yellow visible image forming unit UY, that is, a photoconductor Py, the charging roll CRy, the LED head LHy and a photoconductor cleaner CLy are configured in the same manner. Detailed description about the developing units Gy to Gk will be made later.

The surfaces of the photoconductors Py to Pk are charged uniformly in charging areas Q1*y*, Q1*m*, Q1*c* and Q1*k* opposed to the charging rolls CRy to CRk by the charging rolls CRy to CRk respectively. Then, latent images are written on the surfaces of the photoconductors Py to Pk by the LED heads LHy to LHk in latent image forming areas Q2*y*, Q2*m*, Q2*c* and Q2*k* respectively. The written electrostatic latent images are developed into toner images in developing areas Q3*y*, Q3*m*, Q3*c* and Q3*k* opposed to the developing units Gy to Gk respectively. The developed toner images are conveyed to primary transfer areas Q4*y*, Q4*m*, Q4*c* and Q4*k* contacting with an intermediate transfer belt B which is an example of an intermediate transfer. In the primary transfer areas Q4*y*, Q4*m*, Q4*c*, Q4*k*, primary transfer voltages whose polarities are reverse to the charged polarity of the toners are applied to primary transfer rolls T1*y*, T1*m*, T1*c* and T1*k* at given times respectively by the power supply circuit E controlled by the control portion C. Each primary transfer roll T1*y*, T1*m*, T1*c*, T1*k* is an example of a primary transfer disposed on the back surface side of the intermediate transfer belt B.

According to the first embodiment, as shown in FIG. 2, in the visible image forming units UY to UK, the Y primary transfer area Q4*y* as an example of a second transfer area, the M primary transfer area Q4*m* as an example of a first transfer area, the C primary transfer area Q4*c* as an example of a first transfer area and the K primary transfer area Q4*k* as an example of a first transfer area are disposed on a straight line along the intermediate transfer belt B respectively.

The toner images on the photoconductors Py to Pk are primarily transferred onto the intermediate transfer belt B by the primary transfer rolls T1*y*, T1*m*, T1*c* and T1*k* respectively.

Residual or attached materials such as untransferred toners or corona products on the surfaces of the photoconductors Py, Pm, Pc and Pk after the primary transfer are cleaned up by the photoconductor cleaners CLy, CLm, CLc and CLk respectively. The cleaned surfaces of the photoconductors Py, Pm, Pc and Pk are charged again by the charging rolls CRy, CRm, CRc and CRk respectively. Residual materials etc. that cannot be removed by the photoconductor cleaners CLy to CLk but adhere to the charging rolls CRy to CRk are cleaned up by charger cleaners CCy, CCm, CCc and CCk disposed in contact with the charging rolls CRy to CRk, respectively. Each charger cleaner CCy, CCm, CCc, CCk is an example of a charger cleaning member.

In FIG. 2, a belt module BM which is an example of an intermediate transfer unit is disposed above the photoconductors Py to Pk. The belt module BM includes the intermediate transfer belt B which is an example of an object to be transferred and an example of an intermediate transfer. The intermediate transfer belt B is supported rotatably by an intermediate transfer support system which is constituted by a belt driving roll Rd as an example of a driving member, a backup roll T2*a* as an example of a driven member and an example of a secondary transfer opposed member, and the primary transfer rolls T1*y*, T1*m*, T1*c* and T1*k* disposed in opposition to the photoconductors Py to Pk respectively.

A belt cleaner CLb as an example of an intermediate transfer cleaner is disposed above the rear portion of the intermediate transfer belt B. The belt cleaner CLb has a cleaning vessel CLb1, a belt cleaning blade CLb2, a film CLb3 and a residual material conveyance member CLb4. The belt cleaning blade CLb2 is an example of a cleaning member, which is supported on the cleaning vessel CLb1 and brought into contact with the intermediate transfer belt B to remove and clean residual materials staying on the surface of the intermediate transfer belt B. The film CLb3 is an example of a leakage prevention member, which prevents the residual materials removed by the belt cleaning blade CLb2 from flying out and leaking out. The residual material conveyance member CLb4 is disposed in the cleaning vessel CLb1 to convey and discharge the removed residual materials. The cleaning vessel CLb1 according to the first embodiment is disposed in a position above the black photoconductor cleaner CLk.

A secondary transfer roll T2*b* which is an example of a secondary transfer member is disposed in opposition to the surface of the intermediate transfer belt B which is in contact with the backup roll T2*a*. A secondary transfer T2 as an example of a final transfer unit according to the first embodiment is constituted by the backup roll T2*a* and the secondary transfer roll T2*b*. A secondary transfer area Q5 is formed by the area where the secondary transfer roll T2*b* and the intermediate transfer belt B are opposed to each other.

Unicolor or multi-color toner images transferred to overlap one another in turn on the intermediate transfer belt B in the primary transfer areas Q4*y*, Q4*m*, Q4*c* and Q4*k* by the primary transfer rolls T1*y*, T1*m*, T1*c* and T1*k* respectively are conveyed to the secondary transfer area Q5.

A transfer unit T1+T2+B according to the first embodiment, which transfers the images on the surfaces of the photoconductors Py to Pk onto a medium, is constituted by the primary transfer rolls T1*y* to T1*k*, the intermediate transfer belt B, and the secondary transfer unit T2.

As shown in FIG. 2, the intermediate transfer belt B according to the first embodiment is disposed so that the primary transfer areas Q1*y* to Q1*k* descend rearward with respect to the horizontal plane. Correspondingly thereto, the visible image forming units UY to UK are also disposed so that one on the downstream side in the belt rotation direction is displaced downward in the direction of gravity from another on the upstream side.

Under the visible image forming units UY to UK, a paper feed tray TR1 is provided as an example of a medium storage portion. The paper feed tray TR1 has a bottom wall TR1*a*, a rear end wall TR1*b* and an upper wall TR1*c*. The bottom wall TR1*a* is an example of a lower wall. The rear end wall TR1*b* extends upward from the rear end of the bottom wall TR1*a*. The upper wall TR1*c* is disposed above the bottom wall TR1*a* and in opposition thereto. A supply port TR1*d* for supplying new recording sheets S is formed in the front end portion of the paper feed tray TR1. The front end portion of the upper wall TR1*c* is formed to ascend frontally toward the outside of the supply port TR1*d*. Accordingly, the distance between the upper wall TR1*c* and the bottom wall TR1*a* in the supply port TR1*d* becomes larger on the front side. Thus, the supply port TR1*d* is formed to be wider on the front side. to be wider on the front side.

A lifting plate PL1 as an example of a media loading portion is disposed on the bottom wall TR1*a*. The lifting plate PL1 is supported rotatably around a rotation center PL1*a* and loaded with the recording sheets S as an example of media so as to lift the recording sheets S. A lifting spring PL2 as an example of an urging member for urging a rear end portion of the lifting plate PL1 upward is disposed on a rear end portion of the lifting plate PL1. When image formation is not performed, the lifting plate PL1 moves to a descending position where the lifting plate PL1 is kept in parallel with the bottom wall TR1*a* by depressing members PL3 shaped like eccentric cams. The depressing members PL3 are disposed in the opposite left and right end portions of the lifting plate PL1. During image formation, the depressing members PL3 are rotated so that the lifting plate PL1 is supported movably between the descending position and an ascending position where the lifting plate PL1 has been lifted by the lifting spring PL2 as shown in FIG. 2.

When the front cover U2 is opened, the supply port TR1*d* is opened to the outside. Thus, a new sheaf of recording sheets S can be inserted to abut against the rear end wall TR1*b* so as to be loaded and received on the lifting plate PL1 in the descending position.

A paper feed roll Rp as an example of a feeding-out member is disposed at the rear of the upper wall TR1*c*. The paper feed roll Rp is disposed in a position where the uppermost recording sheet S of the loaded recording sheets S can be pushed against the paper feed roll Rp by the spring force of the lifting spring PL2 in the state where the lifting plate PL1 has moved to the ascending position. A retard roll Rs as an example of a separation member is disposed above the rear end wall TR1*b*.

The recording sheets S loaded on the paper feed tray TR1 are fed out by the paper feed roll Rp, and separated one by one in the area where the retard roll Rs and the paper feed roll Rp are in contact with each other. Each separated recording sheet S is conveyed to a medium conveyance path SH. The recording sheet S in the medium conveyance path SH is conveyed to registration rolls Rr which are examples of paper feed timing adjustment members. The recording sheet S conveyed to the registration rolls Rr is fed out to the secondary transfer area Q5 in sync with the timing when the toner images on the intermediate transfer belt B reach the secondary transfer area Q5.

From the intermediate transfer belt B where the toner images have been transferred in the secondary transfer area Q5, residual materials such as untransferred toners or corona products staying on the surface of the intermediate transfer belt B are removed and cleaned by the belt cleaner CLb.

The recording sheet S to which the toner images have been transferred is conveyed to a fixing area Q6 of a fixing unit F. The fixing unit F has a heating roll Fh as an example of a heating fixing member and a pressure roll Fp as an example of a pressure fixing member. The fixing area Q6 consists of an area where the heating roll Fh and the pressure roll Fp are in contact with each other with a predetermined pressure. The unfixed toner images on the surface of the recording sheet S are fixed by heat and pressure when the toner images pass through the fixing area Q6.

The recording sheet S where the images have been fixed is conveyed in the medium conveyance path SH, and discharged to the discharge tray TRh through discharge rollers Rh which are examples of medium discharge members.

Figure 3:
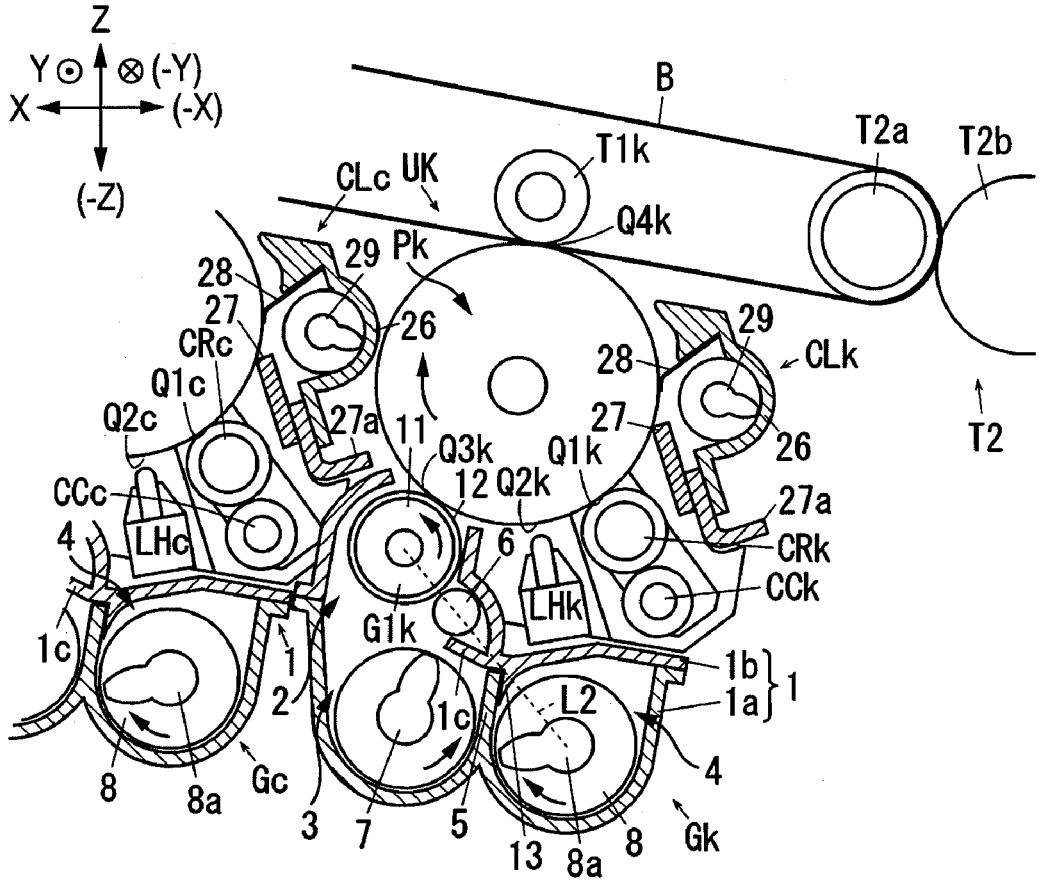
FIG. 3 is a main portion enlarged explanatory view of a visible image forming unit according to the first embodiment of the invention.

FIG. 3 is a main portion enlarged explanatory view of a visible image forming unit according to the first embodiment of the invention.

Figure 4:
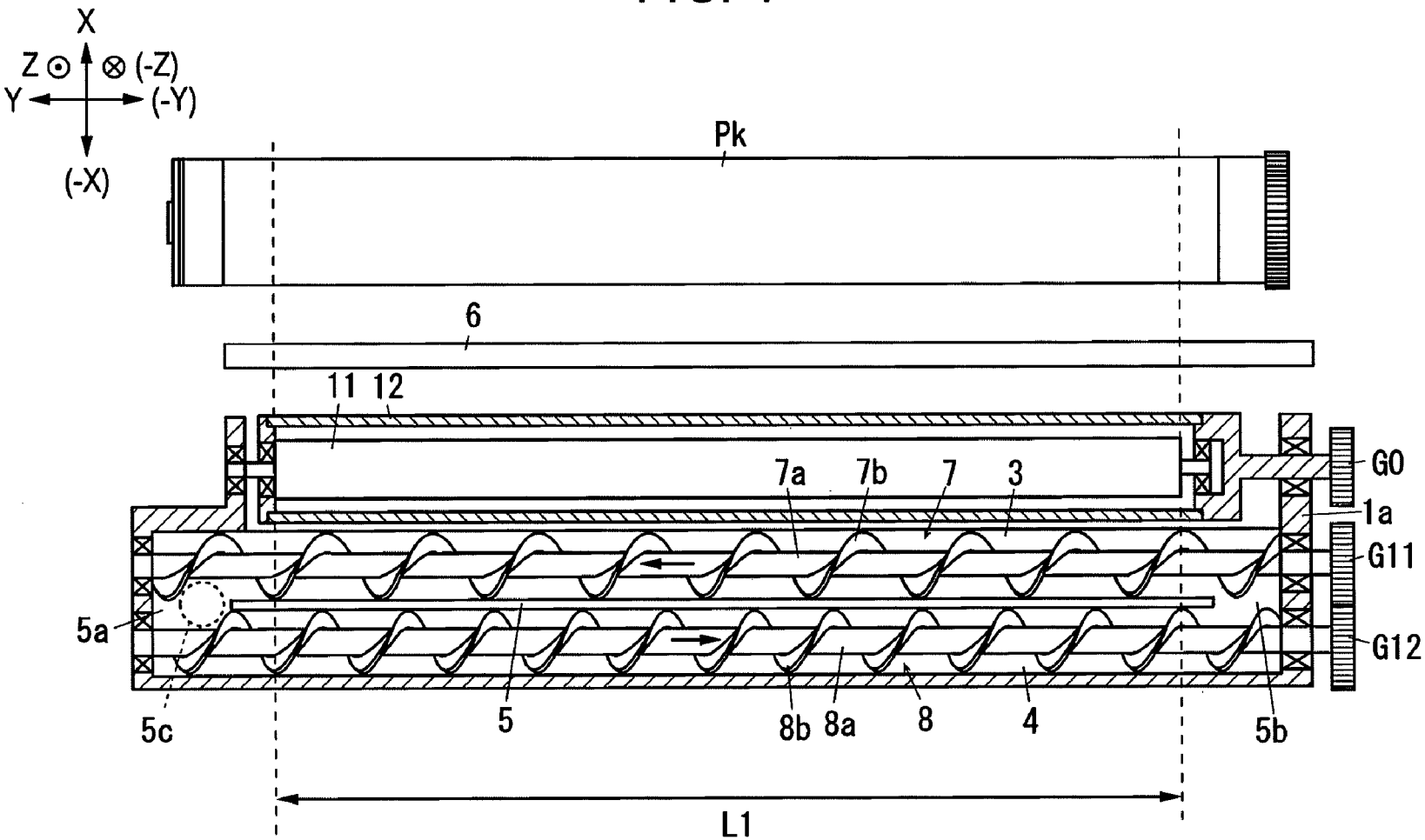
FIG. 4 is a view for explaining a positional relationship among a developing vessel, a layer thickness limiting member and a developing roll according to the first embodiment.

FIG. 4 is a view for explaining the positional relationship among a developing vessel, a layer thickness limiting member and a developing roll according to the first embodiment.

Next, the developing units according to the first embodiment will be described. The developing units Gy to Gk for the respective colors Y, M, C and K are constituted in the same manner. Therefore, only the black visible image forming unit UK will be described, but detailed description about the other yellow, magenta and cyan developing units Gy to Gc will be omitted.

In FIG. 3, the black developing unit Gk according to the first embodiment is disposed under the photoconductor Pk. The developing unit Gk has a developing vessel 1 for receiving a developer internally. The developing vessel 1 has a lower vessel body 1*a* and a cover member 1*b* for covering the top of the vessel body 1*a*. In the developing vessel 1 according to the first embodiment, the cover member 1*b* is made of a magnetic material.

A developing roll chamber 2 as an example of a retainer receiving portion, a supply chamber 3 as an example of a first agitation portion and an agitation chamber 4 as an example of a second agitation portion are provided inside the developing vessel 1. The developing roll G1*k* as an example of a developer retainer is received in the developing roll chamber 2. The supply chamber 3 is formed to be adjacent to and continuous with the bottom of the developing roll chamber 2. The agitation chamber 4 is formed to be adjacent to the rear of the supply chamber 3.

In FIG. 3, in the developing vessel 1 according to the first embodiment, the agitation chamber 4 is disposed on a lower level than the supply chamber 3 in the direction of gravity.

In FIGS. 3 and 4, the supply chamber 3 and the agitation chamber 4 are partitioned by a partition 5 which is an example of a partition member extending in the left/right direction. In addition, a right inlet portion 5*a* as an example of a first connection portion and a left inlet portion 5*b* as an example of a second connection portion are formed in the opposite right and left end portions of the partition 5 so that a developer can flow between the supply chamber 3 and the agitation chamber 4.

The inlet portions 5*a* and 5*b* are formed correspondingly to the outside of an image forming area L1 where an image will be formed on the photoconductor Pk. Thus, a developer flowing in and out through the inlet portions 5*a* and 5*b* is restrained from giving an adverse effect to image formation. The image forming area L1 is an example of a retaining area where an image will be retained by the image retainer.

In the developing unit Gk according to the first embodiment, a supply port 5*c* is disposed in the right inlet portion 5*a*. The supply port 5*c* is an example of a supply portion, through which a new developer is supplied from above.

In FIGS. 3 and 4, the developing roll G1*k* has a columnar magnet roll 11 as an example of a magnet member, which is fixedly supported on the developing vessel 1. According to the first embodiment, the axial length of the magnet roll 11 is set to be equivalent to the length of the image forming area L1. A cylindrical developing sleeve 12 surrounding the magnet roll 11 is supported rotatably on the outer circumference of the magnet roll 11. The developing sleeve 12 is an example of a retaining member. A gear G0 as an example of a gear is fixedly supported on a left end of the developing sleeve 12. A driving force is transmitted from a not-shown developing unit motor to the gear G0 so as to rotate the developing sleeve 12. The developing unit motor is an example of a developing drive source. The rotation direction of the developing roll G1*k* according to the first embodiment is set to be reverse to that of the photoconductor Pk. That is, in FIG. 3, the developing roll G1*k* rotates counterclockwise in a reverse direction to that of the photoconductor Pk which rotates clockwise. Accordingly, in the developing area Q3*k*, the surface of the photoconductor Pk rotates in the same direction as the surface of the developing roll G1*k*.

A trimmer 6 which is an example of a magnet member and an example of a layer thickness limiting member is supported in the developing roll chamber 2 and disposed on the upstream side of the developing area Q3*k* in the rotation direction of the developing roll G1*k*. The trimmer 6 is disposed at a predetermined distance from the developing sleeve 12 and in opposition thereto so as to limit the layer thickness of a developer layer retained on the surface of the developing roll G1*k*. The trimmer 6 according to the first embodiment is constituted by a columnar rod-like member made of a magnetic material. In addition, the left/right-direction length of the trimmer 6 is set to be as long as the inside distance between the right inlet portion 5*a* and the left inlet portion 5*b*, and to be longer than the length of the magnet roll 11.

In FIGS. 3 and 4, a supply auger 7 as an example of a first agitation member extending in the left/right direction is rotatably supported in the supply chamber 3. The supply auger 7 has a supply shaft 7*a* as an example of a first rotary shaft, which extends in the supply chamber 3 in the left/right direction. A supply spiral 7*b* as an example of a first conveyance blade is supported on the outer circumference of the supply shaft 7*a*. A gear G11 as an example of a gear is fixedly supported on the left end of the supply shaft 7*a*. In FIGS. 3 and 4, according to the first embodiment, the rotation direction of the supply auger 7 is set so that when a driving force is transmitted to the supply auger 7 from a not-shown drive source so as to rotate the supply auger 7, the developer in the supply chamber 3 is conveyed from left to right in a first conveyance direction by the supply spiral 7*b* so as to flow into the agitation chamber 4 through the right inlet portion 5*a*.

An admix auger 8 as an example of a second agitation member extending in the left/right direction and in parallel with the supply auger 7 is rotatably supported in the agitation chamber 4. The admix auger 8 has an admix shaft 8*a* as an example of a second rotary shaft, which extends in the left/right direction. An admix spiral 8*b* as an example of a second conveyance blade is supported on the outer circumference of the admix shaft 8*a*. A gear G12 as an example of a gear is fixedly supported on a left end of the admix shaft 8*a*. The gear G12 engages with the gear G11 of the supply auger 7. In FIG. 4, according to the first embodiment, the rotation direction of the admix auger 8 is set so that when a driving force is transmitted to the admix auger 8 so as to rotate the admix auger 8, the developer in the agitation chamber 4 is conveyed from right to left in a second conveyance direction reverse to that of the supply auger 7 so as to flow into the supply chamber 3 through the left inlet portion 5*b*. Accordingly, by the supply auger 7 and the admix auger 8, the developer is circulated and conveyed while being agitated through a circulating chamber 3+4 consisting of the supply chamber 3 and the agitation chamber 4.

Further, in FIG. 3, the rotation direction of the admix auger 8 according to the first embodiment is set so that the admix auger 8 can rotate from below to above in the direction of gravity in the supply auger side area of the admix shaft 8*a* in a section perpendicular to the admix shaft 8*a* shown in FIG. 3. Accordingly, a force to lift the developer from the lower agitation chamber 4 toward the upper supply chamber 3 acts on the developer in the left inlet portion 5*b* due to the rotating admix spiral 8*b* so as to urge the developer to flow into the upper supply chamber 3.

Figure 5:
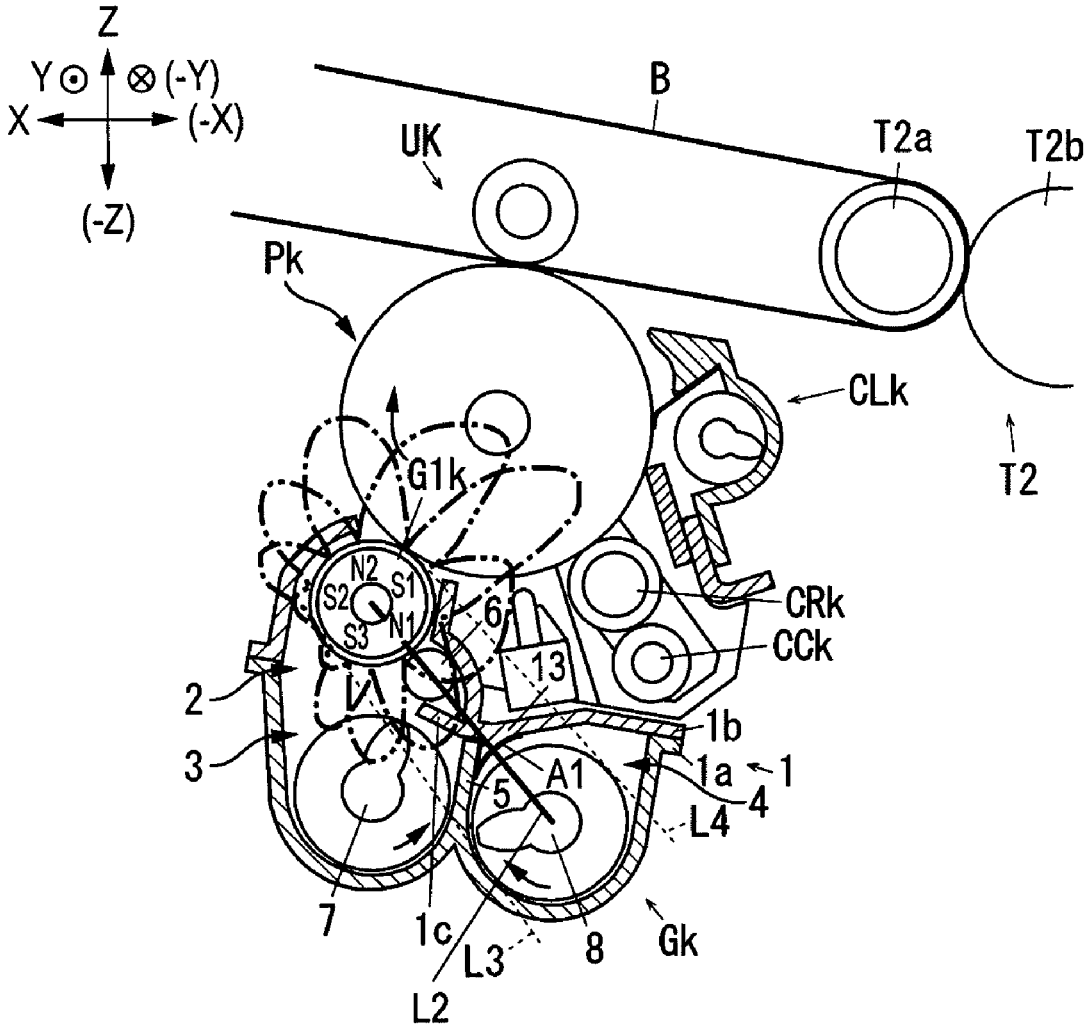
FIG. 5 is a view for explaining magnetic poles of a developing unit according to the first embodiment.

FIG. 5 is a view for explaining magnetic poles of each developing unit according to the first embodiment.

In FIG. 5, in the developing unit Gk according to the first embodiment, the magnetic roll 11 has a developing magnetic pole S1 disposed correspondingly to the developing area Q3*k*. A trimming magnetic pole N1 as an example of a layer thickness limiting magnetic pole for axially arranging or erecting particles of the developer is disposed in opposition to the trimmer 6 and on the upstream side of the developing magnetic pole S1 in the rotation direction of the developing sleeve 12. A conveyance magnetic pole N2 for retaining the developer on the developing sleeve 12 is disposed on the downstream side of the developing magnetic pole S1 in the rotation direction of the developing sleeve 12. A pickoff magnetic pole S2 as an example of a separation magnetic pole for separating the developer from the developing sleeve 12 and a pickup magnetic pole S3 as an example of a suction magnetic pole for sucking the developer in the supply chamber 3 onto the developing sleeve 12 are disposed on the downstream side of the conveyance magnetic pole N2. As shown in FIG. 5, the magnetic field generated by the respective magnetic poles according to the first embodiment is set so that the intensity of the magnetic poles in the normal direction of the developing sleeve 12 has a distribution expressed by the chain single-dashed lines and the intensity of the magnetic poles in the tangent direction along the circumferential direction of the developing sleeve 12 has a distribution expressed by the chain double-dashed lines.

Thus, the trimmer 6 made of a magnetic material according to the first embodiment is disposed between the developing roll G1*k* and the admix auger 8. In addition, a front end portion of a top wall portion 13 of the cover member 1*b* made of a magnetic material and constituting the top of the agitation chamber 4 is also disposed between the developing roll G1*k* and the admix auger 8. Accordingly, the cover member 1*b* has a function as a wall surface forming member in the first embodiment.

Thus, in the developing unit Gk according to the first embodiment, the trimmer 6 and the top wall portion 13 are at least partially disposed on a straight line L2 connecting the position of the trimming magnetic pole N1 where the normal magnetic force of the magnetic pole is maximal and the rotation center of the developing roll G1*k*.

Particularly in the first embodiment, the trimmer 6 and the top wall portion 13 are received in an area surrounded by common tangents L3 and L4 of the developing roll G1*k* and the circumscribed circle of the admix auger as shown by the broken lines in FIG. 5.

In FIGS. 3 and 4, an eave portion 1*c* is formed under the trimmer 6. The eave portion 1*c* is an example of a reduction portion, which extends obliquely upward and forward from the front end of the top wall portion 13 of the cover member 1*b* toward the trimmer 6. That is, the eave portion 1*c* according to the first embodiment is formed integrally with the developing vessel 1.

Accordingly, the eave portion 1*c* is disposed in a space 14 which is on the upstream side of the trimmer 6 in the rotation direction of the developing sleeve 12, that is, on the entrance side of the developer to the trimmer 6, and between the trimmer 6 and the admix auger 8. The eave portion 1*c* is disposed so that the front edge portion thereof is close to the surface of the trimmer 6.

In addition, the length of the eave portion 1*c* in the left/right direction is set to be as long as the distance between the right end of the right inlet portion 5*a* and the left end of the left inlet portion 5*b*. The eave portion 1*c* covers not only the image forming area L1 but also the whole areas of the right inlet portion 5*a* and the left inlet portion 5*b*. Thus, the length of the eave portion 1*c* in the left/right direction is set to be longer than the developing roll G1*k* or the trimmer 6.

In the printer U configured thus according to the first embodiment of the invention, the developer circulated in the circulating chamber 3+4 of each developing unit Gy to Gk is attracted by the magnetic force of the magnet roll 11 of the developing roll G1*y* to G1*k* in the supply chamber 3, sucked and retained on the surface of the developing sleeve 12 and used for development.

Here, in the developing unit Gy to Gk according to the first embodiment, the trimming magnetic pole N1 is disposed correspondingly to the trimmer 6, while the agitation chamber 4 and the admix auger 8 are disposed on an extended line connecting the developing unit Gy to Gk and the trimmer 6.

In the configuration of the developing unit Gy to Gk according to the first embodiment, the developing vessel 1 is miniaturized so that the distance between the developing roll G1*y* to G1*k* and the admix auger 8 becomes short. If the trimmer 6 or the top wall portion 13 were not made of a magnetic material, there is a possibility that the magnetic force of the trimming magnetic pole N1 would reach the agitation chamber 4 so that the developer might be sucked in an area A1 which is an inner side portion of the top wall portion 13 of the agitation chamber 4. The sucked developer might be so lumpy that the conveyance of the developer in the agitation chamber 4 might be unstable due to the developer staying there. Thus, there is a possibility that the image quality might deteriorate due to density unevenness caused by poor development or the like.

On the other hand, according to the first embodiment, the trimmer 6 and the top wall portion 13 are made of magnetic materials. The lines of magnetic force are disturbed in the agitation chamber 4 rather than in the trimmer 6. In comparison with the case where the trimmer 6 and the top wall portion 13 are made of nonmagnetic materials, the magnetic force is lowered in the agitation chamber 4. Accordingly, in each developing unit Gy to Gk according to the first embodiment, the magnetic force in the area A1 is reduced so that bad conveyance of the developer due to the suction of the developer can be suppressed, and poor development can be also reduced.

Particularly in the configuration of the first embodiment, the admix auger 8 rotates to lift the developer from the agitation chamber 4 toward the supply chamber 3. Thus, in the agitation chamber 4, the developer is apt to lean to the inner side of the front end of the top wall portion 13, that is, toward the supply chamber 3 so that the developer leaning thus is apt to be sucked. In other words, the developer is apt to be sucked conspicuously when the trimmer 6 or the top wall portion 13 is made of a nonmagnetic material. However, according to the first embodiment, the suction of the developer can be reduced due to the trimmer 6 or the top wall portion 13. Thus, the developer can be conveyed smoothly from the lower agitation chamber 4 toward the upper supply chamber 3, while bad conveyance can be reduced.

Further, the trimmer 6 made of a magnetic material according to the first embodiment may be magnetized due to the magnetic force of the trimming magnetic pole N1. If the end portions of the trimmer 6 with the developer adhering to the trimmer 6 approached the inlet portions 5*a* and 5*b*, there is a possibility that the flow of the developer in the inlet portions 5*a* and 5*b* might be disturbed by the sucked developer. However, the trimmer 6 according to the first embodiment is set to be as long as the inside distance between the right inlet portions 5*a* and the left inlet portion 5*b*. Therefore, the end portions of the trimmer 6 do not overlap the inlet portions 5*a* and 5*b*, so that bad conveyance of the developer can be suppressed.

Figure 6B:
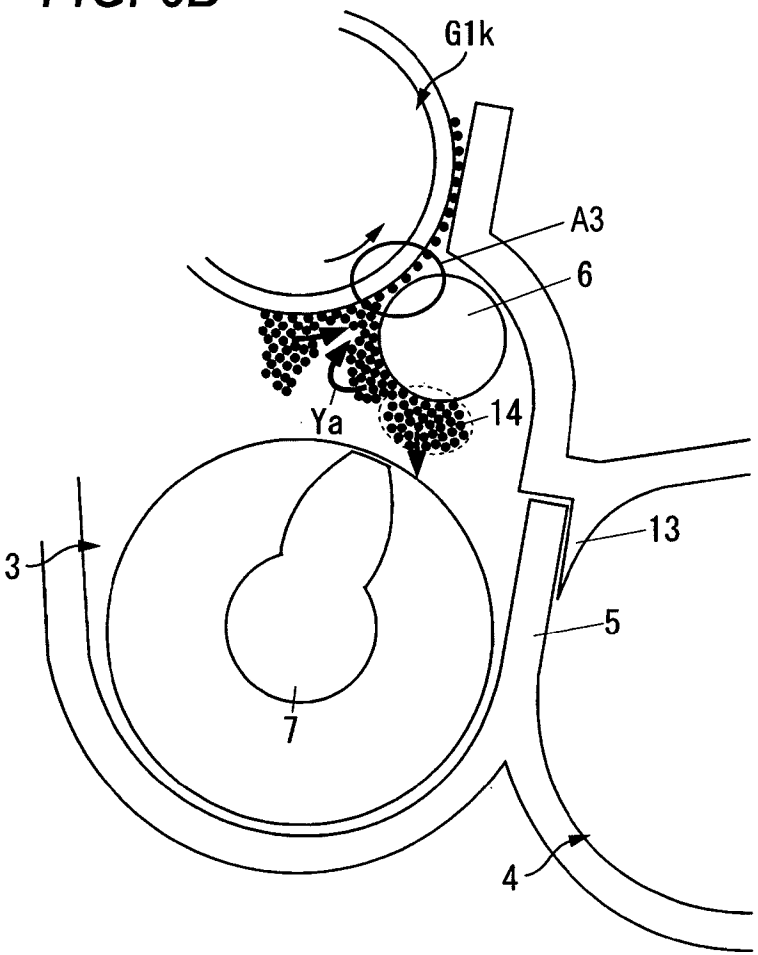
FIGS. 6A and 6B are views for explaining the operation of a blocking portion according to the first embodiment, FIG. 6A being a view for explaining a configuration where the blocking portion is provided according to the first embodiment, FIG. 6B being a view for explaining a configuration where the blocking portion is not provided.
Figure 6A:
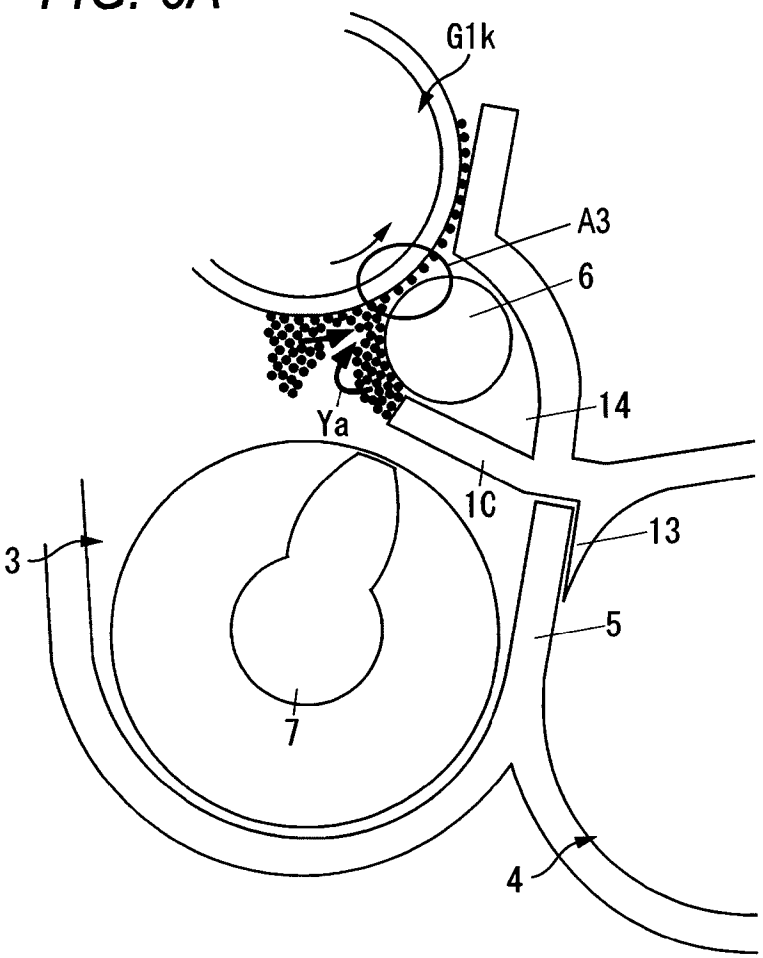

FIGS. 6A and 6B are views for explaining the operation of a blocking portion according to the first embodiment. FIG. 6A is a view for explaining a configuration where the blocking portion is provided according to the first embodiment. FIG. 6B is a view for explaining a configuration where the blocking portion is not provided.

In FIGS. 6A and 6B, in the configuration where the trimmer 6 having magnetism is used, the trimmer 6 is magnetized by the magnetic force of the magnet roll 11, and a developer adheres to the surface of the trimmer 6. Accordingly, when the developer sucked on the surface of the developing sleeve 12 by the pickup magnetic pole S3 passes through a trimming area A3 which is an example of a layer thickness limiting area where the developing sleeve 12 and the trimmer 6 are opposed to each other, the developer is limited and pushed by the developer which is sucked on the developing sleeve 12 and conveyed from the upstream side. Thus, the limited developer moves downward along the surface of the trimmer 6. Of the developer sucked due to the magnetic field of the trimmer 6, the developer near the developing sleeve 12 is mixed into the developer conveyed from the upstream side in the rotation direction of the developing sleeve 12 as shown by the arrow Ya in FIGS. 6A and 6B. Thus, the mixed developer is conveyed again to the trimming area A3 while being charged frictionally.

However, in FIG. 6B, if the eave portion 1*c* were not provided, the developer sucked on the trimmer 6 in the space 14 away from the developing sleeve 12 would be pushed by the developer limited in the trimming area A3. Thus, the sucked developer would be kept sucked and staying in the space 14 without being mixed with the developer conveyed from upstream in the rotation direction of the developing sleeve 12. Accordingly, the electrostatic charge of the developer in the space 14 would be reduced due to spontaneous discharge with age. When the electrostatic charge of the developer is reduced, the insufficiently charged developer would leave the trimmer 6 and fall down to the supply chamber 3 easily. The insufficiently charged developer falling down to the supply chamber 3 would be sucked again by the pickup magnetic pole S3 in the condition that the frictional electrification of the developer due to agitation is left insufficient. Thus, there is a possibility that the insufficiently charged developer might be used for development so that an image defect such as tailing or drop stain of toner might occur.

On the other hand, in the developing unit Gy to Gk according to the first embodiment, as shown in FIG. 6A, the entrance of the developer into the space 14 is reduced due to the eave portion 1*c*. In comparison with the case where the eave portion 1*c* is not provided, entrance and staying of the developer in the space 14 is reduced. In addition, even if the developer enters the space 14 and stays there, the staying developer is restrained from falling down to the supply chamber 3 so that bad influence of the staying developer's falling down can be reduced. Thus, development with an insufficiently charged developer can be reduced so that occurrence of an image defect can be also reduced.

In addition, in the developing unit Gy to Gk according to the first embodiment, the partition 5 is not formed in each inlet portion 5*a*, 5*b*, but the top of the inlet portion 5*a*, 5*b* is opened so that the space 14 becomes wide. Thus, a developer is apt to stay in the space 14. In addition, the volume of the staying developer is apt to be large. On the other hand, in the developing unit Gy to Gk according to the first embodiment, the eave portion 1*c* is disposed also in a region corresponding to each inlet portion 5*a*, 5*b* to suppress occurrence of a developer staying to be large in volume and insufficient in electrification. Thus, it is possible to prevent an image defect such as tailing or drop stain of toner.

In addition, the left inlet portion 5*b* is located on the upstream side of the supply auger 7 in the conveyance direction of a developer. Accordingly, when a developer which is large in volume and insufficient in electrification leaves the trimmer 6 and falls down to the supply chamber 3, the developer may be sucked by the pickup magnetic pole S3. Thus, there is a possibility that the insufficiently charged developer might be used for development so that an image defect such as tailing or drop stain of toner might occur. On the other hand, due to the eave portion 1*c* disposed in an area corresponding to the left inlet portion 5*b*, the occurrence of a developer staying to be large in volume and insufficient in electrification can be suppressed to prevent an image defect such as tailing or drop stain of toner.

Figure 7:
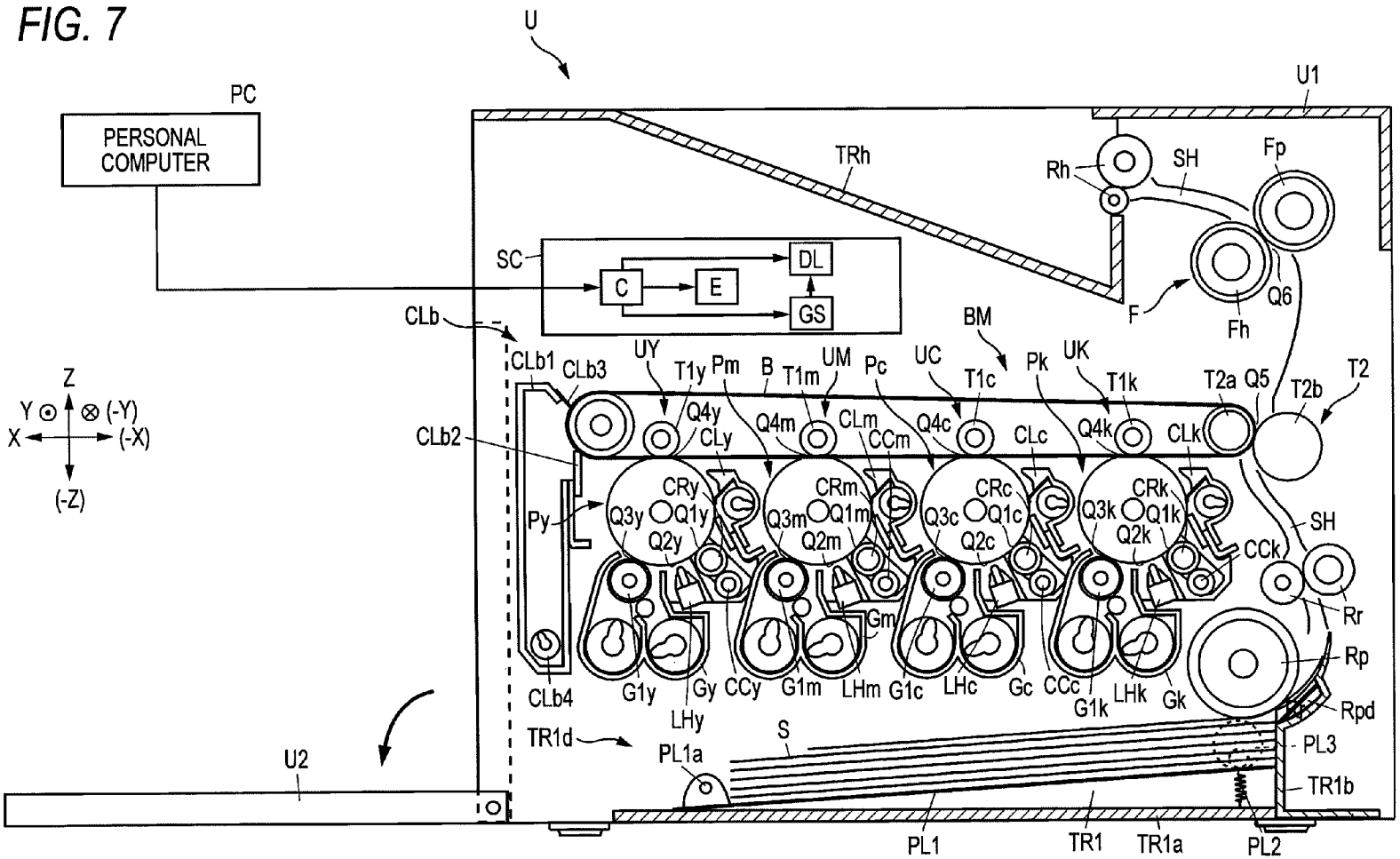
FIG. 7 is an overall explanatory view of an image forming apparatus according to a second embodiment of the invention, and a view corresponding to FIG. 2 of the first embodiment.

FIG. 7 is an overall view for explaining an image forming apparatus according to a second embodiment of the invention. FIG. 7 corresponds to FIG. 2 of the first embodiment.

Figure 8:
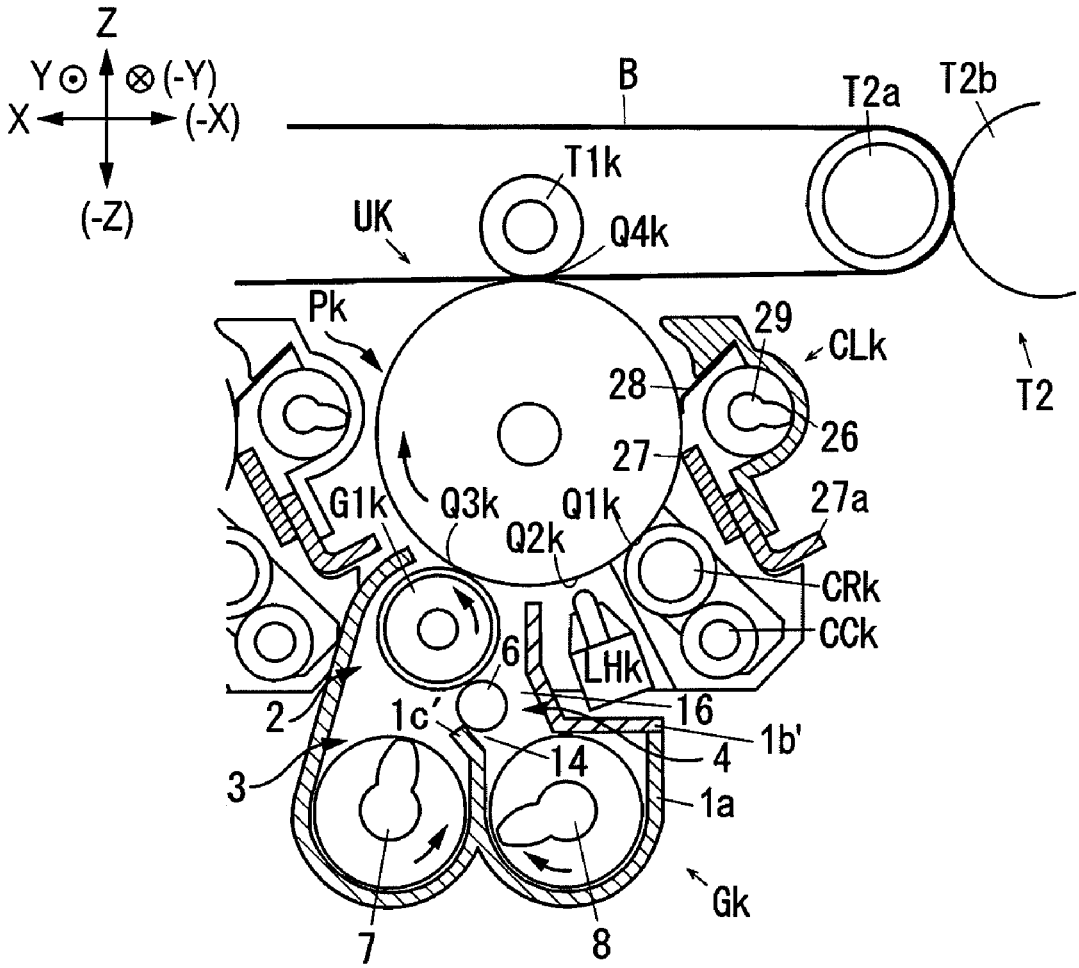
FIG. 8 is a view for explaining a developing unit according to the second embodiment, and a view corresponding to FIG. 3 of the first embodiment.

FIG. 8 is a view for explaining each developing unit according to the second embodiment. FIG. 8 corresponds to FIG. 3 of the first embodiment.

Next, the second embodiment of the invention will be described. In the description of the second embodiment, constituent members corresponding to those in the first embodiment are referred to by the same numerals, and detailed description thereof will be omitted.

The second embodiment is configured in the same manner as the first embodiment except the following points.

In FIG. 7, unlike the first embodiment, in the printer U according to the second embodiment, the intermediate transfer belt B is not inclined downward on the rear side but is disposed substantially horizontally. In addition, unlike the first embodiment, in each developing unit Gy to Gk according to the second embodiment, the supply chamber 3 and the agitation chamber 4 are set substantially on the same level in the direction of gravity, and an eave portion 1*c*' is supported not on the cover member 1*b* but on the upper end of the partition 5. Further, according to the second embodiment, the shape of a cover member 1*b*' is changed to form a connection path 16 which connects the downstream side of the trimmer 6 in the rotation direction of the developing sleeve 12, that is, an exit side of the developer from the trimmer 6, with the agitation chamber 4.

In the developing unit Gy to Gk configured thus according to the second embodiment, in the same manner as in the first embodiment, the developer on the upstream side of the trimmer 6 is blocked by the eave portion 1*c*' from entering the space 14, so that an insufficiently charged developer can be restrained from being used for development. In addition, a developer dropping off from the developing sleeve 12 after the layer thickness of the developer is limited by the trimmer 6 or falling down to the downstream side of the trimmer 6 from the developing area Q3*y* to Q3*k* falls down to the connection path 16. On this occasion, a developer may be sucked on the magnetized trimmer 6 and the electrostatic charge of the developer may be lowered with age. Even when such an insufficiently charged developer falls down from the trimmer 6, the developer does not fall down to the supply chamber 3 but falls down to the agitation chamber 4. Accordingly, the insufficiently charged developer is frictionally charged when it is conveyed through the agitation chamber 4 while being agitated. Thus, the frictionally charged developer is apt to be conveyed to the supply chamber 3 so that the insufficiently charged developer can be restrained from being supplied to the developing roll G1*y* to G1*k*. Thus, the image quality can be restrained from deteriorating due to the insufficiently charged developer.

The embodiments of the invention have been described above in detail. The invention is not limited to the embodiments, but various modifications can be made thereon without departing from the gist of the invention stated in the appending claims. Modifications (H01) to (H11) of the invention will be described below by way of example.

(H01) In each of the aforementioned embodiments, the printer U is constituted by a so-called printer. However, the invention is not limited thereto. For example, the invention can be applied to a copying machine, a facsimile machine, or a composite machine with a plurality of or all of those functions of the copying machine and the facsimile machine.

(H02) In each of the aforementioned embodiments, the printer U is not limited to a configuration where toners of four colors are used, but may be applied to a configuration where toners of five or more colors or toners of two or three colors are used.

(H03) In the first embodiment, it is desired that the relationship in height in the direction of gravity between the supply chamber 3 and the agitation chamber 4, the inclination of the intermediate transfer belt B, the rotation directions of each developing roll G1*y* to G1*k*, the supply auger 7 and the admix auger 8, etc. are set in the illustrated manner. However, the invention is not limited to such a configuration, but may be changed suitably in accordance with design, specification or the like.

(H04) In the first embodiment, it is desired that both the trimmer 6 and the cover member 1*b* are made of magnetic materials. However, either the trimmer 6 or the cover member 1*b* may be made of a magnetic material. Also in this case, bad conveyance can be reduced in comparison with the case where both the trimmer 6 and the cover member 1*b* are made of nonmagnetic materials.

(H05) In each of the aforementioned embodiments, the trimmer 6 is formed to have a shape like a round bar member. However, the invention is not limited to such a configuration, but the trimmer 6 may be formed into any shape such as a plate-like shape.

(H06) In each of the aforementioned embodiments, the whole of the cover member 1*b* is made of a magnetic material. However, the invention is not limited to such a configuration. For example, only the top wall portion 13 may be made of a magnetic material, or the cover member may be made of a nonmagnetic material such as resin while a plate or the like made of a magnetic material is pasted onto the wall surface of the cover member.

(H07) In each of the aforementioned embodiments, the eave portion 1*c*, 1*c*' may be formed into any shape. For example, the eave portion 1*c*, 1*c*' may be formed into any shape such as a shape which extends not toward the trimmer 6 but forward from the top wall portion 13, or a shape whose wall surface swells.

(H08) In each of the aforementioned embodiments, the eave portion 1*c*, 1*c*' as an example of a reduction portion is formed integrally with the cover member 1*b* or the partition 5. However, the invention is not limited to such a configuration. For example, the eave portion 1*c*, 1*c*' may be formed out of another member.

(H09) In each of the aforementioned embodiments, the length of the blocking portion along the axis of the developing roll G1*y* to G1*k* is not limited to the illustrated configuration, but may be set into any length. In addition, the blocking portion does not have to be provided in the axially central portion but the blocking portion may be provided only in the area corresponding to each inlet portion 5*a*, 5*b* that is an axial end portion.

(H010) In each of the aforementioned embodiments, the configuration is made so that each developing roll G1*y* to G1*k* includes the magnet roll 11 which is fixed supported and the developing sleeve 12 which rotates. However, the invention is not limited to such a configuration. For example, the invention may be applied to a developing roll including a magnetic roll which rotates to convey a developer.

(H011) In each of the aforementioned embodiments, the configuration is made so that the intermediate transfer belt B is used as an example of an intermediate transfer. However, the invention is not limited to such a configuration. For example, the invention may be applied to a configuration in which an intermediate transfer such as an intermediate transfer drum is used. In addition, the invention can be also applied to an image forming apparatus in which images are transferred from the photoconductors Py to Pk directly to the sheet S without using any intermediate transfer.

What is claimed is:

1. A developing unit comprising:

a developer retainer that includes a magnet member and a retaining member, the magnet member having magnetic poles, the retaining member being supported on an outer circumference of the magnet member and retaining a developer magnetized and sucked on a surface of the retaining member by a magnetic force of the magnet member;

a developing vessel that receives the developer internally and that includes a retainer receiving portion, a first agitation portion and a second agitation portion, the retainer receiving portion receiving the developer retainer, the first agitation portion being adjacent to the retainer receiving portion, the second agitation portion being adjacent to the first agitation portion;

a first conveyance member that is received in the first agitation portion and that conveys the developer in the first agitation portion in a first conveyance direction;

a second conveyance member that is received in the second agitation portion and that conveys the developer in the second agitation portion in a second conveyance direction which is reverse to the first conveyance direction;

a layer thickness limiting member that is provided in opposition to the developer retainer to limit a layer thickness of the developer retained on the surface of the retaining member, that is disposed between the second conveyance member and the developer retainer and that is made of a magnetic material;

a reduction portion that is disposed on an upstream side of the layer thickness limiting member in a direction of rotation of the retaining member and in a space between the layer thickness limiting member and the second agitation portion, the reduction portion reducing entrance of the developer on the upstream side of the layer thickness limiting member into the space a partition member that partitions the first agitation portion and the second agitation portion;

a first connection portion that connects a downstream end of the first agitation portion in the first conveyance direction and an upstream end of the second agitation portion in the second conveyance direction; and a second connection portion that connects an upstream end of the first agitation portion in the first conveyance direction and a downstream end of the second agitation portion in the second conveyance direction;

wherein the reduction portion is disposed in a region corresponding to at least the second connection portion.

2. The developing unit according to claim 1, wherein:

the reduction portion is formed integrally with the developing vessel.

3. The developing unit according to claim 1, further comprising:

a connection path that connects an exit side of the layer thickness limiting member and the second agitation portion.

4. An image forming apparatus comprising:

an image retainer having a surface on which a latent image is formed;

a developing unit according to claim 1, that is disposed in opposition to the image retainer and that develops the latent image on the surface of the image retainer into a visible image;

a transfer unit that transfers the visible image on the surface of the image retainer to a surface of a medium; and a fixing unit that fixes the visible image on the surface of the medium.

5. A developing unit comprising:

a developer retainer that includes a magnet member and a retaining member, the magnet member having magnetic poles, the retaining member being supported on an outer circumference of the magnet member and retaining a developer magnetized and sucked on a surface of the retaining member by a magnetic force of the magnet member;

a developing vessel that receives the developer internally and that includes a retainer receiving portion, a first agitation portion and a second agitation portion, the retainer receiving portion receiving the developer retainer, the first agitation portion being adjacent to the retainer receiving portion, the second agitation portion being adjacent to the first agitation portion;

a first conveyance member that is received in the first agitation portion and that conveys the developer in the first agitation portion in a first conveyance direction;

a second conveyance member that is received in the second agitation portion and that conveys the developer in the second agitation portion in a second conveyance direction which is reverse to the first conveyance direction;

a layer thickness limiting member that is provided in opposition to the developer retainer to limit a layer thickness of the developer retained on the surface of the retaining member, that is disposed between the second conveyance member and the developer retainer and that is made of a magnetic material;

a reduction portion that is disposed on an upstream side of the layer thickness limiting member in a direction of rotation of the retaining member and in a space between the layer thickness limiting member and the second agitation portion, the reduction portion reducing entrance of the developer on the upstream side of the layer thickness limiting member into the space;

a partition member that partitions the first agitation portion and the second agitation portion;

a first connection portion that connects a downstream end of the first agitation portion in the first conveyance direction and an upstream end of the second agitation portion in the second conveyance direction; and a second connection portion that connects an upstream end of the first agitation portion in the first conveyance direction and a downstream end of the second agitation portion in the second conveyance direction;

wherein the reduction portion is disposed in a region corresponding to at least the first and second connection portions.

* * * * *